United States Patent [19]

Sipos et al.

[11] Patent Number: 4,842,058

[45] Date of Patent: Jun. 27, 1989

[54] LOAD DETECTION AND INDICATOR APPARATUS FOR WELL TUBING OR THE LIKE

[75] Inventors: David L. Sipos; Duane M. Kuske; Paul D. White, Jr., all of Houston, Tex.

[73] Assignee: Bowen Tools, Inc., Houston, Tex.

[21] Appl. No.: 248,579

[22] Filed: Sep. 26, 1988

[51] Int. Cl.[4] ..... E21B 19/08

[52] U.S. Cl. ..... 166/77; 166/113; 166/250; 166/385; 73/862.58; 177/208

[58] Field of Search ..... 166/77, 113, 250, 385; 73/862.58, 151; 177/208, 209, 254

[56] References Cited

U.S. PATENT DOCUMENTS 3,658,270 4/1972 Slator et al. ..... 242/75.53 X
4,133,206 1/1979 Hida et al. ..... 73/862.58 X
4,450,906 5/1984 Firmin ..... 166/113
4,676,312 6/1987 Mosing et al. ..... 166/77

*Primary Examiner*—Bruce M. Kisliuk
*Attorney, Agent, or Firm*—Pravel, Gambrell, Hewitt, Kimball & Krieger

[57] ABSTRACT

A load cell apparatus especially suitable for detecting and indicating loads on tubing injected into or withdrawn out of a well with an injector apparatus. The load cell apparatus is located longitudinally directly below the injector apparatus to avoid angling of the tubing as it is run into, or pulled out of, a well. Two gauges are provided to independently indicate positive and negative loads on the tubing and to facilitate determining whether the pipe has hit an obstruction in a well. A fluid chamber is provided to support the weight of the tubing head, facilitating accurate load cell readings.

11 Claims, 5 Drawing Sheets

LOAD DETECTION AND INDICATOR APPARATUS FOR WELL TUBING OR THE LIKE

FIELD OF THE INVENTION

The field of this invention is apparatus for detecting and indicating the amounts of loads or forces on objects such as well tubing supported by apparatus for moving the tubing into and/or out of a well.

BACKGROUND OF THE INVENTION

This invention is an improvement over the device disclosed in U.S. patent application Ser. No. 205,824, filed June 13, 1988. For a number of years, well tubing has been inserted into and removed from wells for performing various operations. Examples of apparatus for that purpose are shown in U.S. Pat. Nos. 3,182,877; 3,285,485; 3,313,346; 3,658,270; 3,675,719; 3,690,136; 3,690,381; 3,722,589; 3,722,594; and 3,791,447. U.S. Pat. Nos. 3,182,877 and 3,285,485 show an apparatus wherein the well tubing is lowered and raised through a vertically aligned two-gauge means for detecting and indicating loads or forces on the well tubing in both upward and downward directions. It has been common practice in more recent years to provide a pivoted mounting of such equipment in conjunction with a load cell for detecting and indicating the compressive loading or forces on the pipe in the downward direction only, an illustration of which is shown in FIG. 1 of the drawings, as will be more fully explained.

SUMMARY OF THE INVENTION

This invention relates to a new and improved apparatus for detecting and indicating loads on elongate objects such as well tubing or the like which moves relative to the apparatus.

More specifically, the apparatus is a load cell which is disposed concentrically below a well tubing injector apparatus with guide means to restrict angular deviation of the well tubing from the well axis and kinking of the well tubing in the event of a buckling load. The load cell has a separate compensating means for providing neutral buoyancy to the injector apparatus apart from the means for measuring either positive or negative loads on the injector apparatus relative to such neutral buoyancy position. The positive and negative measuring mechanisms are separated and arranged to ensure no lost motion during cross-over from positive to negative loads, or vice versa, and to also obtain independent operation of each of two gauges to assure accurate gauge readings for both positive and negative loads.

DESCRIPTION OF THE PREFERRED EMBODIMENT

Figure 1:
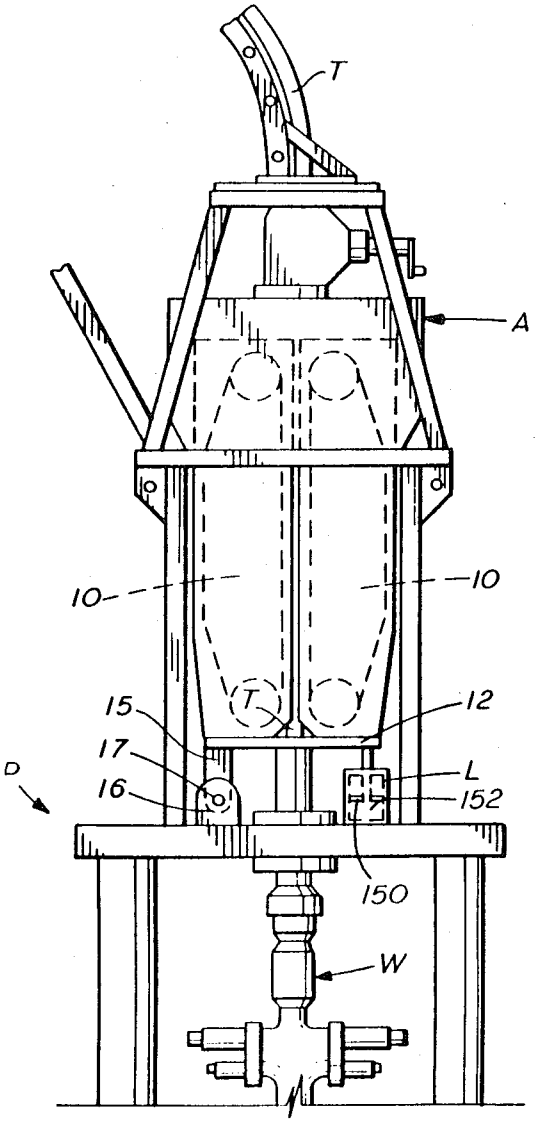
FIG. 1 (PRIOR ART)
FIG. 1 is an elevation which generally illustrates a typical prior art injector apparatus with a prior art load cell arrangement.

In the drawings, the letter A designates generally the injector apparatus which is only schematically illustrated. A detailed example of an injector apparatus is disclosed in U.S. Pat. No. 3,285,485. Briefly, the injector apparatus A is adapted to feed or inject a tubing or pipe T between two endless drive chains 10 for the purpose of feeding or withdrawing the tubing T into or out of a well through wellhead equipment W at the upper end of the well. The typical wellhead equipment W illustrated schematically in the drawings includes blowout preventers and other controls which form no part of the present invention. The prior art apparatus shown in FIG. 1 is not shown in any patent so far as is known, but it is typical of the load cell apparatus used with well tubing in recent years. Considering the illustrating of such prior art apparatus in FIG. 1, as shown schematically, the injector apparatus A has a pair of endless chain drive assemblies 10 mounted on a base 12. The base 12 is pivotally mounted to the well platform P by a pivoted arrangement which is schematically shown as a downwardly extending pivot member 15 which is pivotally connected to an upstanding pivot member 16 mounted on the platform P, with a pivot pin 17 providing for the pivoting movement of the member 15 relative to the member 16. The member 15 is welded or is otherwise secured to the base 12 so that the central portion of the apparatus A can pivot or move about the pivot pin 17.

On the other side of the base 12 from the pivot, a conventional load cell L has been used in the past. Such load cell is schematically shown in FIG. 1 as having a piston 150 in a closed chamber 152, which has fluid below the piston 150. In the typical use of the apparatus A, the tubing T has been forced into a well through the well equipment W, where the well is under pressure so that it requires a pushing force downwardly on the tubing T to force it into the well. This is particularly true where the lower end of the tubing T has a check valve closing off the lower end of the tubing T, which is a typical way in which the tubing T is injected into a well. In the past, with the prior art arrangement of FIG. 1, the force or load on the tubing T has been measured with the load cell L by the chain drive assemblies 10 of the apparatus A tilting about the pivot pin 17 in a clockwise direction as viewed in FIG. 1. Such movement imparted a compressive force to the liquid in the chamber 152 below the piston 150 which was responsive to the amount of force or load on the tubing T. That force was indicated on a typical conventional gauge.

Figure 2:
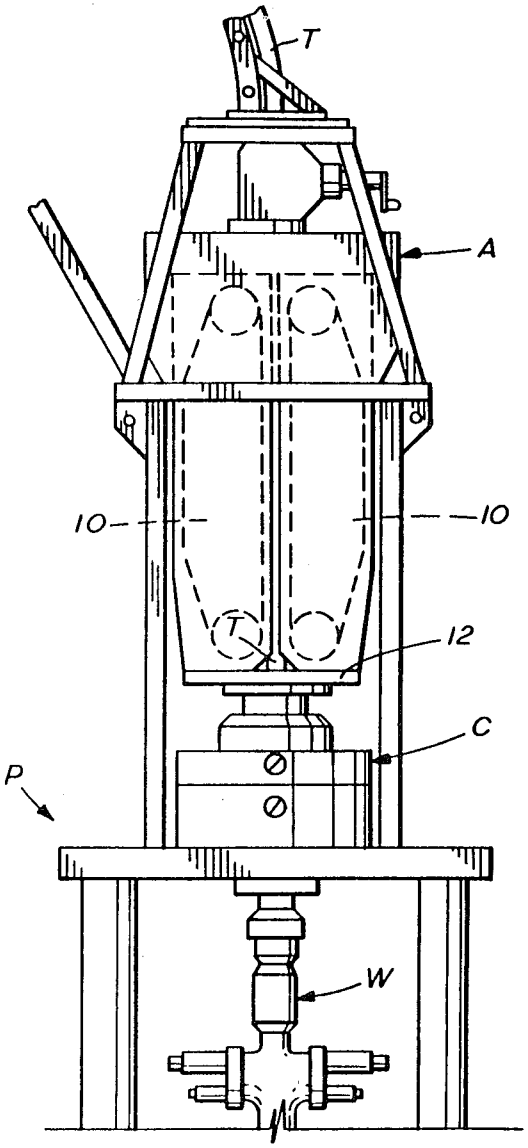
FIG. 2 (PRIOR ART)
FIG. 2 is an elevation which generally illustrates the invention described in application Ser. No. 205,824, filed June 13, 1988, showing the load cell apparatus for injecting or withdrawing tubing from a well.

The invention of application ser. No. 205,824 is shown schematically in FIG. 2 and in detail in FIG. 3 of the drawings. The parts of the apparatus of this invention shown in FIG. 2 which are the same as in FIG. 1 are identified with the same letters and numerals as in FIG. 1. As can be seen in FIG. 2, the injector apparatus A is mounted on a load cell apparatus C which is disposed longitudinally directly below the apparatus A with the longitudinal passage between the endless chain assemblies 10 in alignment with the longitudinal opening through the well equipment W. The base 12 is mounted on the load cell apparatus C so that it does not pivot. Also, the load cell apparatus C is so constructed that readings of the amount of the load on the tubing T in either the downward direction or the upward direction can be obtained.

Figure 3:
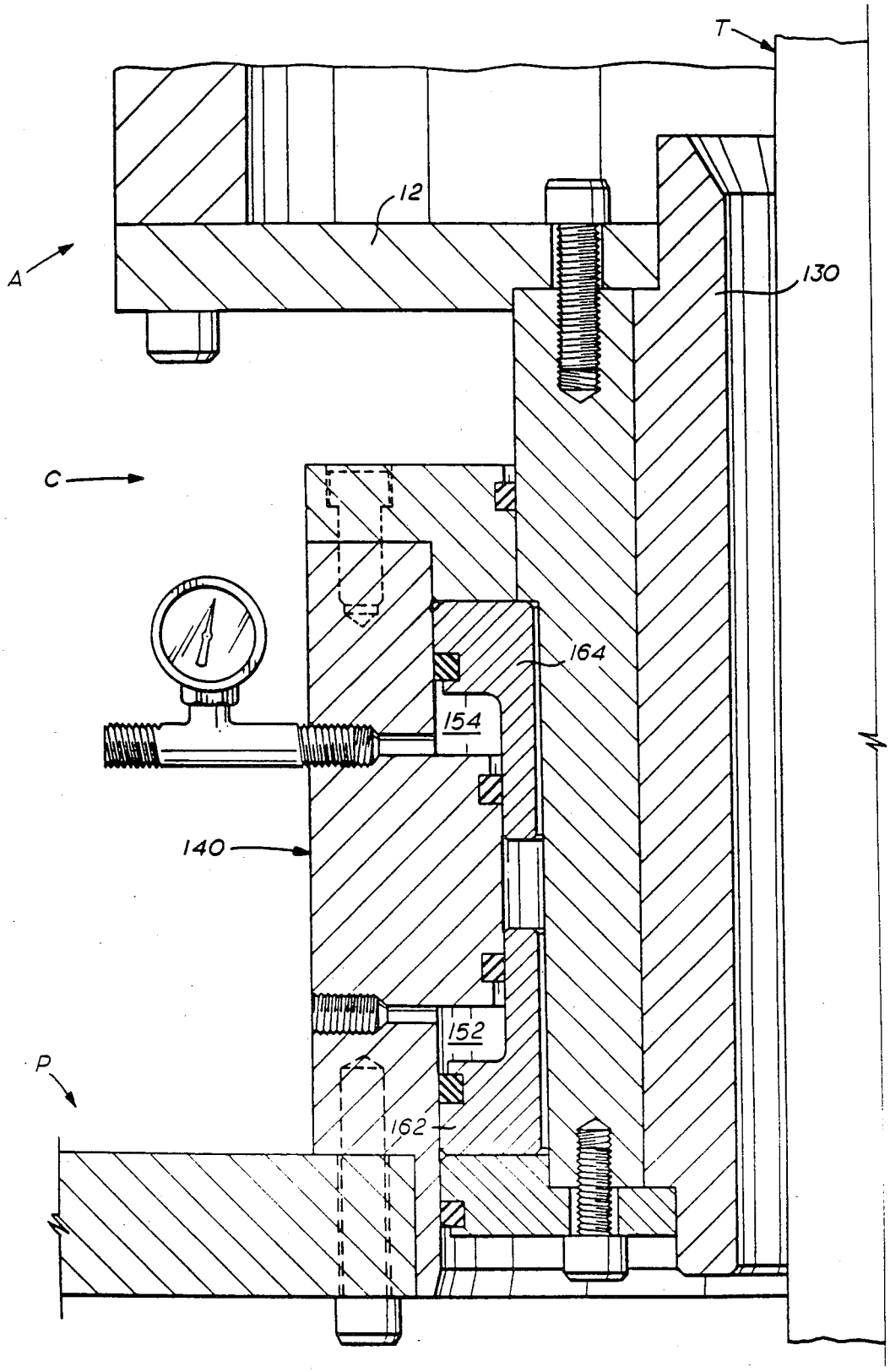
FIG. 3 (PRIOR ART)
FIG. 3 is a view partly in section and partly in elevation, illustrating the load cell apparatus of application Ser. No. 205,824, filed June 13, 1988.

The load cell C illustrated in FIG. 2 is shown in detail in FIG. 3. In FIG. 3, the load cell apparatus C of this invention is shown positioned between and connected to the base 12 of the apparatus A and the platform P for the well. Apparatus A pushes tubing into the well via the central opening longitudinally through tubular guide 130. As upward or downward force is exerted by the tubing, Apparatus A moves slightly upwardly or downwardly along with lower piston 162 or upper piston 164, depending on the direction of motion. Load cell housing 140 remains stationary, causing an increase or decrease in pressure in fluid pressure sections 152, 154. This operation is similar to the functioning of a portion of the present invention, as will now be explained in more detail.

Figure 4:
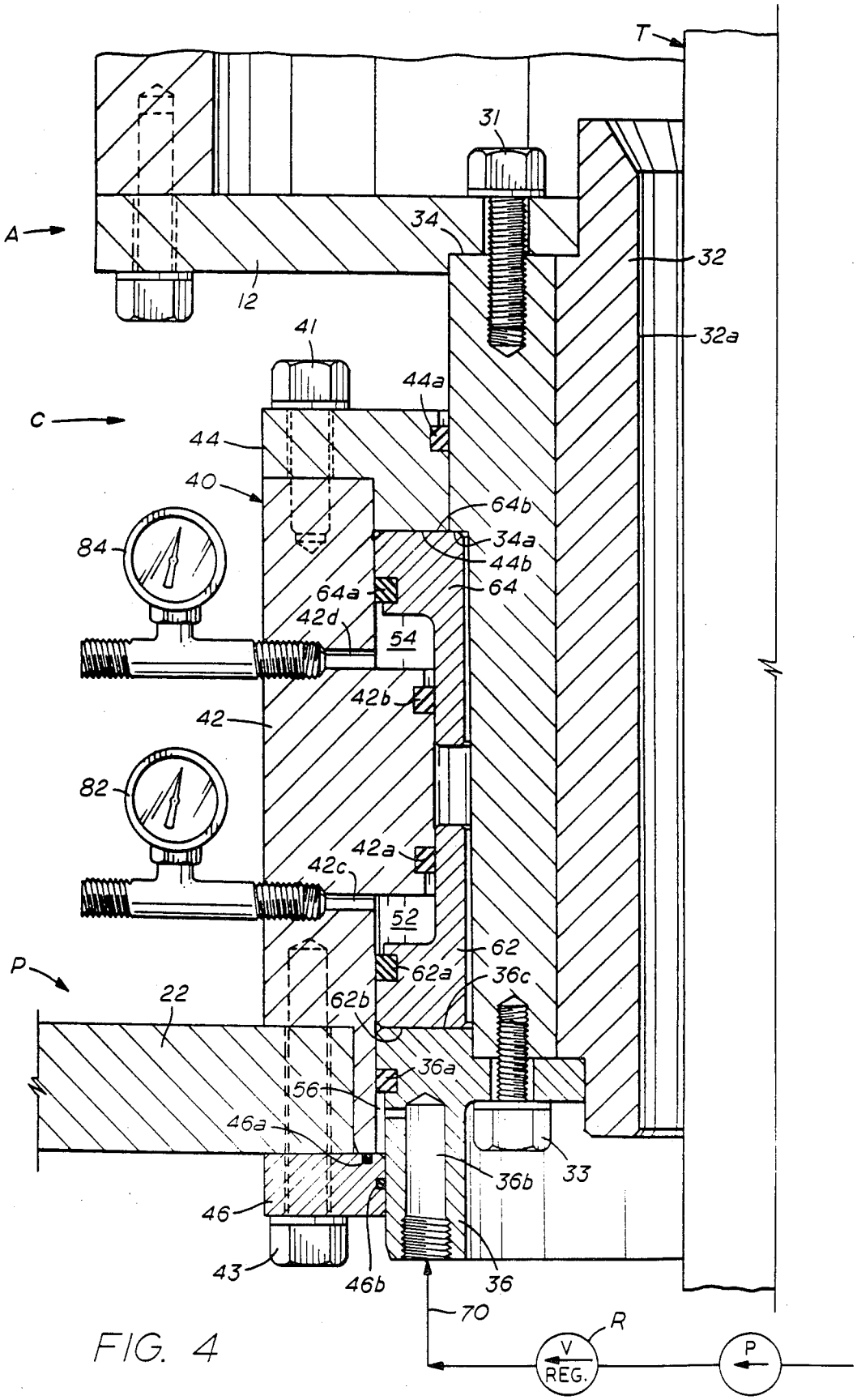
FIG. 4 is a view partly in section and partly in elevation, illustrating the load cell apparatus of the present invention when the tubing is not imparting a load or force in either direction on the apparatus.

Referring now to FIG. 4, the present invention is illustrated. The base 12 is connected to the injector apparatus A. The load cell apparatus C of FIG. 4 is disposed between such base 12 and the platform P. The tubular guide is formed of two parts, an inner tubular guide member 32 and an outer tubular guide member 34. By means of a lower annular plate 36 and bolts 31, 33 the guide members 32 and 34 are connected to the base 12 and are movable longitudinally therewith.

The diameter of the inner surface 32*a* of the inner tubular guide member 32 is large enough for the tubing T to move freely through the member 32, but the annular spacing of such inner surface 32*a* from the tubing is close enough to serve as a guide for the tubing as it moves substantially vertically into and out of the well, and additionally to provide lateral support for the tubing T to prevent it from buckling if an obstruction is encountered by the tubing T when moving into the well. Further, the member 32 may be interchangeable with other guide members having smaller or larger diameters of the inner surface 32*a* to provide the foregoing features for tubing of different outside diameters.

The fluid pressure housing 40 is formed by a cylinder 42 and an upper annular plate 44. Bolts 41, 43 secure the housing sections 42 and 44 together and also to the platform 22. A fluid pressure chamber is provided between the guide cylinder 34 and the housing cylinder 42. Such chamber has an upper fluid pressure section 54 and a lower fluid pressure section 52. A central part of the cylinder 42 separates the sections 52 and 54. Cylinder 42 has suitable resilient seals 42*a*, 42*b* preferably made of rubber or other elastomer which seal against the external surfaces of upper piston 64 and lower piston 62, respectively. The upper piston 64 has a similar seal 64*a* and the lower piston 62 has a similar seal 62*a* for sealing against the inside annular surfaces of the housing cylinder 42. Also, a seal 44*a* is provided to seal the upper end of the fluid pressure chamber, and a seal 36*a* closes off the lower end of the fluid pressure chamber from compensating chamber 56.

The external surface of the guide member 34 has an annular lateral shoulder 34*a* which is in lateral alignment with the lower annular surface 44*b* of upper annular plate 44; these surfaces are engaged by the upper surface 64*b* of the piston 64 when the piston 64 is in the upper position shown in FIG. 4. The shoulder 34*a* engages the piston 64 to transmit downward movements of the guide 32, 34 to the piston 64, as will be explained.

FIG. 4 illustrates the modified load cell C in the neutral position when the tubing T is not exerting a force in either direction on the base 12. Preferably, the compensating chamber 56 is connected to a liquid pump P through a pressure regulator R, by means of a connector pipe 70 extending from opening 36*b* in movable member 36, or alternatively to an accumulator (not shown) whose function is to provide more or less constant pressure to the compensating chamber 56 while not restricting downward movement of members 32, 34, 36 and also providing pressurized make-up fluid to the compensating chamber 56 during upward movement. In the preferred embodiment, the liquid in the compensating chamber 56 is pressurized by the pump a sufficient amount to apply a lifting force to the base 12 and the portion of the apparatus A which is supported thereon so as to offset the weight of such apparatus, thus making it weightless as if floating on the liquid in the compensating chamber 56. Because of such floating arrangement, the variations which appear on the gauges 82, 84 are indications of only the amount and direction of the force exerted by the tubing T which is supported by the apparatus A.

Figure 4A:
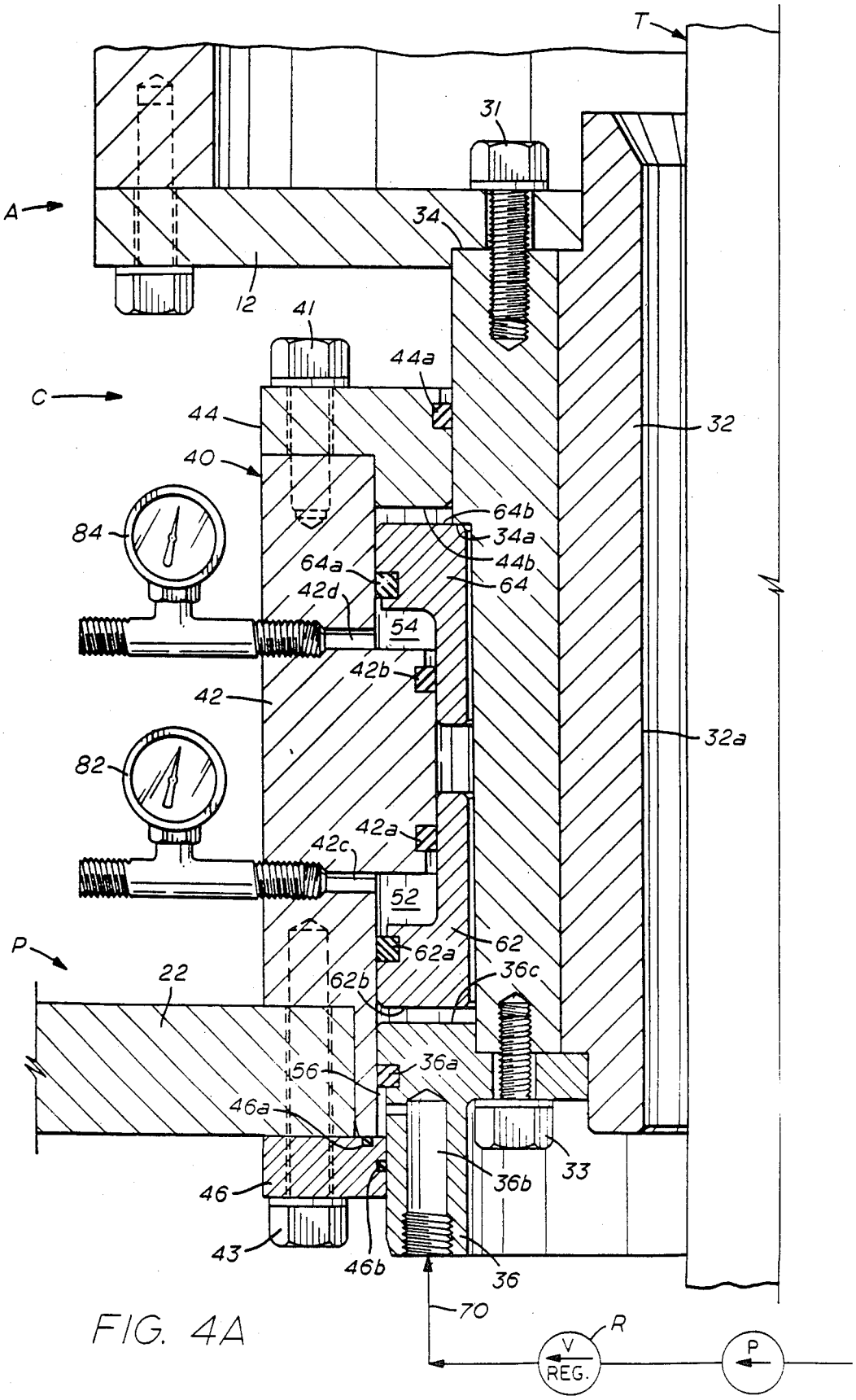
FIG. 4A is a view similar to FIG. 4, but showing the load cell apparatus with a load applied to the load cell apparatus by the tubing as it is injected downwardly into the well.

Referring to FIG. 4A, when a downward force is exerted by the tubing T on the apparatus A, the piston 64 is moved downwardly from the position of FIG. 4 to the position of FIG. 4A due to the downward movement of the guide cylinders 32, 34. Such downward movement of the piston 64 applies a compressive force on the liquid in the upper fluid pressure chamber section 54. Such increase in pressure is transmitted through the opening 42d to gauge 84. It is to be noted that the lower piston 62 does not move downwardly when the piston 64 moves downwardly since they are operable and movable independently of each other. Any tendency of the piston 62 to move downwardly would tend to create a vacuum in chamber section 52 which would hold it in its position as illustrated in FIG. 4A. Also, it will be understood that the amount of movement of the piston 64 illustrated in FIG. 4A is exaggerated for purposes of illustration.

Figure 4B:
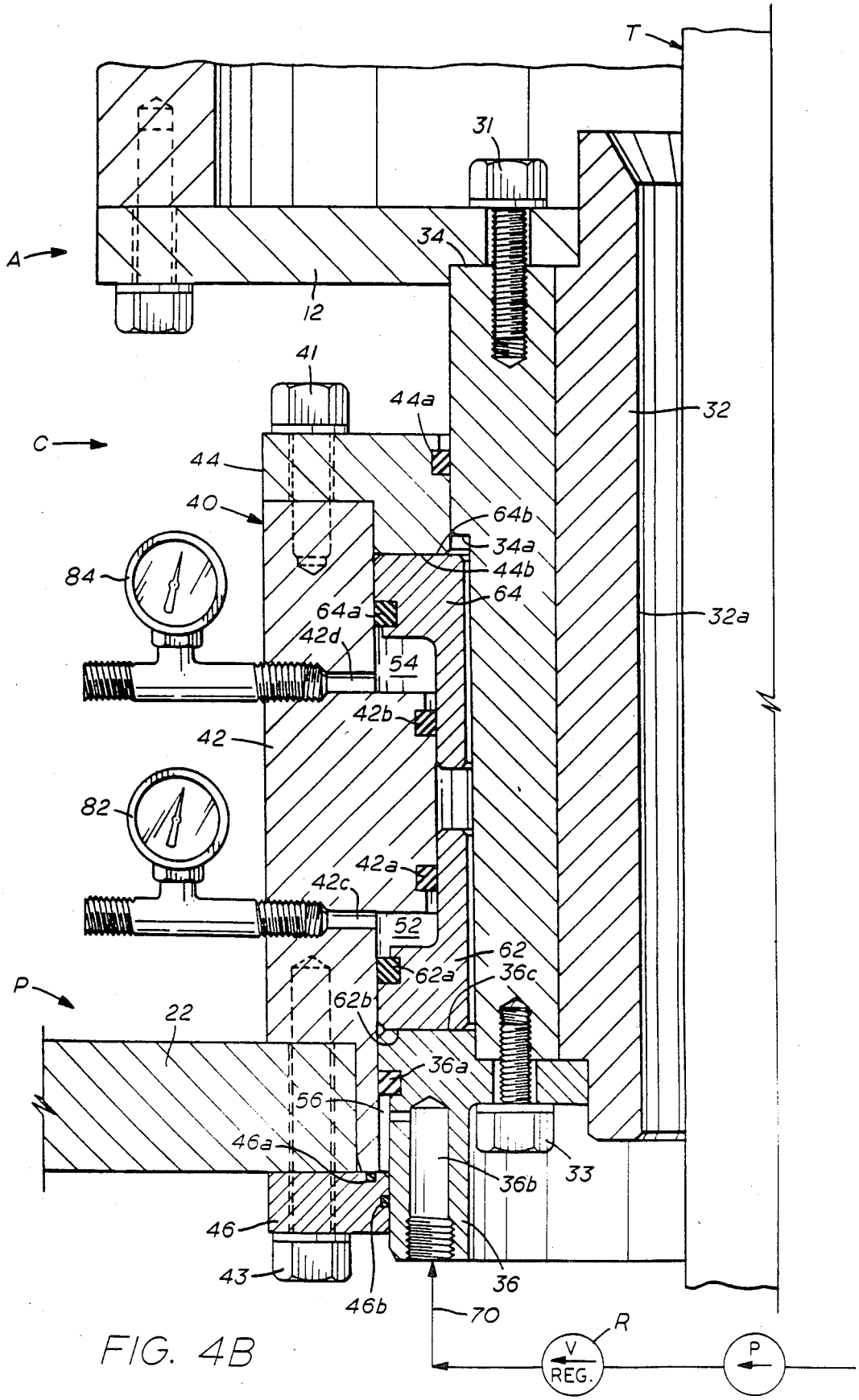
FIG. 4B is a view similar to FIG. 4, but showing the load cell apparatus when the tubing is exerting a load or force in the upward direction.

Referring now to FIG. 4B, the apparatus is shown in a position wherein the tubing T is exerting an upward longitudinal force on the base 12. Such upward force causes the lower piston 62 to be moved upwardly by the upward movement of the plate 36 and the guide members 32, 34, upon engagement of the upper surface 36c with the lower surface 62*b* of piston 62. The fluid in the lower fluid pressure chamber section 52 is pressurized in response to the amount of force in the upward direction from the tubing T and the increased pressure is indicated through a port 42*c* connected to the lower gauge 82.

An intrinsic feature of this invention is that during the initial filling of the fluid chamber sections 52, 54, both pistons 62, 64 are compelled to move away from each other and they come to rest against the shouldered parts of the movable guide cylinder 34 and plate 36 (FIG. 4), thereby ensuring intimate contact therebetween, thereby assuring that there is no slack in the movements of the pistons 62, 64 during use, regardless of the manufacturing tolerances of those parts. Such removal of slack or gaps in the movements of the pistons 62, 64 is valuable since working travel of the movable pistons 62, 64 is measured in very small increments. Thus, the present invention provides for a high degree of accuracy in the force indications on the gauges 82, 84.

Further, because the two chamber sections 52, 54 are divided by an impermeable barrier with seals 42*a*, 42*b* (FIG. 4), inaccuracies due to communication between the two chambers sections 52, 54 are prevented. Therefore, separate independent fluid or pressure signals are reflected on the gauges 82 and 84. Each of the pistons 62, 64 is free to move independently of the other piston and neither is attached to the movable guide cylinder 34. Of prime importance is the fact that, only in the neutral position, i.e., when no load is placed on the load cell C in either direction by the tubing T, does the movable guide cylinder 34 contact both pistons 62, 64 simultaneously (FIG. 4). The moment that the movable guide cylinder 34 moves, it loses contact with one piston but remains in contact with the opposite piston. It is for this reason that the chamber sections 52 and 54 are never subjected to a vacuum-causing load; the error producing section drag, which would be present in a single piston structure, never exists in the present invention.

Although the invention has been disclosed for use with well tubing which is disposed in a vertical or substantially vertical position, it should be understood that the load cell disclosed herein may be used in directions other than vertical and with equipment other than tubing strings.

The foregoing disclosure and description of the invention are illustrative and explanatory thereof, and various changes in the size, shape and materials, as well as in the details of the illustrated construction may be made without departing from the spirit of the invention.

We claim:

1. Apparatus for detecting and indicating loads on an elongate object supported by a support apparatus above a well for movement downwardly or upwardly relative to the apparatus, comprising:

a load cell housing having a longitudinally extending central portion;

a tubular guide positioned in said central portion of said housing for limited longitudinal movement relative to said housing;

a load cell chamber between said housing and said tubular guide;

a first piston extending into said chamber and adapted for longitudinal movement relative to said housing;

a second piston extending into said chamber and longitudinally spaced from said first piston and adapted for longitudinal movement relative to said housing;

said load cell chamber having a sealed first chamber section adjacent said first piston with fluid therein which is adapted to be pressurized by longitudinal movement of said first piston relative to said housing;

said load cell chamber also having a sealed second chamber section adjacent said second piston with fluid therein which is adapted to be pressurized by longitudinal movement of said second piston relative to said housing;

means for imparting longitudinal movements of said tubular guide to either said first piston or said second piston independently of each other to develop a pressure on the fluid in said chamber sections which is indicative of the amount of longitudinal force on said tubular guide;

indicator means associated with each of said chamber sections for indicating the amount of force on said tubular guide;

a weight compensating means operable connected to said tubular guide for offsetting the downward force of said support apparatus for the elongate object, whereby only the upward or downward force of the elongate object is indicated.

2. The apparatus of claim 1, wherein said weight compensating means comprises an expandable chamber, formed between opposing surfaces of said tubular guide and said housing, which can be pressurized to lift said tubular guide with respect to said housing, thereby supporting the weight of said support apparatus independently of said load cell chamber.

3. The apparatus of claim 1, wherein:
said first piston is an upper piston.

4. The apparatus of claim 1, wherein:
said second piston is a lower piston.

5. The apparatus of claim 1, wherein:
said first piston is a lower piston.

6. The apparatus of claim 1, wherein:
said second piston is an upper portion.

7. A load cell apparatus for detecting and indicating loads on tubing wherein the tubing is injected or withdrawn into or out of a well by a tubing injector apparatus, comprising:

a tubular load cell housing disposed directly below said tubing injector apparatus with its longitudinal center in longitudinal alignment with the tubing in the injector apparatus;

a tubular guide disposed in said load cell housing and connected to said tubing injector apparatus for longitudinal movement with said injector apparatus relative to said housing, and through which the tubing moves into and out of the well;

a first annular chamber having a first chamber section and a second chamber section between said tubular housing and said tubular guide and having fluid therein;

a second annular sealed chamber between said tubular housing and said tubular guide and having fluid therein;

means for pressurizing said fluid in said second annular sealed chamber and maintaining a required pressure to support said tubular guide;

a first annular piston disposed in said first chamber section for longitudinal movement with said tubular guide in a first longitudinal direction for developing a fluid pressure in said first chamber section which is indicative of the amount of force exerted by the tubing in said first longitudinal direction;

a second annular piston disposed in said second chamber section longitudinally spaced from said first piston for longitudinal movement with said tubular guide in a second longitudinal direction for developing a fluid pressure in said second chamber section whic is indicative of the amount of the force exerted by the tubing in said second longitudinal direction; and a separate indicator means connected to each of said first chamber section and said second chamber section for indicating the amount of load exerted by the tubing in each of said longitudinal directions.

8. The apparatus of claim 7, including:

means for moving said first annular piston and said second annular piston independently of each other.

9. The apparatus of claim 7, including:

lateral load-bearing means for resisting lateral loads on the tubing injector to thereby maintain the tubing concentrically with respect to said tubular guide and for minimizing angular deviations of the tubing from the longitudinal axis of the well.

10. The apparatus of claim 7, wherein:

said tubular guide has an internal diameter which is larger than the outside diameter of the tubing but which is sufficiently close to the outside diameter of the tubing to prevent buckling of the tubing if the tubing encounters an obstruction which inhibits its downward movement in the well.

11. The apparatus of claim 7, including:

means for ensuring that there is no lost motion of either of said pistons as each moves in response to the load changes in the tubing.

* * * * *

UNITED STATES PATENT AND TRADEMARK OFFICE

CERTIFICATE OF CORRECTION

PATENT NO. : 4,842,058

DATED : June 27, 1989

INVENTOR(S) : David L. Sipos; Duane M. Kuski; Paul D. White, Jr.

It is certified that error appears in the above-identified patent and that said Letters Patent is hereby corrected as shown below:

Column 6, line 3 should read: tubular guide; and

Column 6, line 24 should read: said second piston is an upper piston.

Column 6, line 58 should read: tion which is indicative of the amount of the force

Signed and Sealed this

Twenty-seventh Day of February, 1990

*Attest:*

JEFFREY M. SAMUELS

*Attesting Officer* *Acting Commissioner of Patents and Trademarks*